United States Patent [19]

Richardson et al.

[11] Patent Number: 4,624,590

[45] Date of Patent: Nov. 25, 1986

[54] LETTERING APPARATUS

[75] Inventors: Michael M. Richardson, Scottsdale; Ronald F. Tuckner, Phoenix, both of Ariz.; Douglas A. Schaffer, Inver Grove Heights, Minn.

[73] Assignee: Kroy Inc., Scottsdale, Ariz.

[21] Appl. No.: 811,286

[22] Filed: Dec. 20, 1985

Related U.S. Application Data

[63] Continuation of Ser. No. 549,245, Nov. 4, 1983, abandoned.

[51] Int. Cl.[4] ..... B41J 1/30

[52] U.S. Cl. ..... 400/134.6; 400/134; 400/613; 400/615.2; 400/621

[58] Field of Search ..... 400/48, 134, 134.1, 400/134.2, 134.3, 134.4, 134.5, 134.6, 158, 613, 613.1, 613.2, 613.3, 613.4, 614, 614.1, 615, 615.1, 615.2, 617, 621

[56] References Cited

U.S. PATENT DOCUMENTS

| | | | |
|---|---|---|---|
| 2,951,571 | 9/1960 | Colyer et al. | 400/134 |
| 3,414,102 | 12/1968 | Norvelle | 400/621 |
| 3,625,330 | 12/1971 | Marinoff | 400/134 |
| 3,834,507 | 9/1974 | Bradshaw | 400/134.6 |
| 3,912,064 | 10/1975 | Bluem et al. | 400/134.6 |
| 3,960,256 | 6/1976 | Bickoff et al. | 400/55 |
| 4,239,399 | 12/1980 | Johnstun | 400/613 |
| 4,243,333 | 1/1981 | Bradshaw et al. | 400/613 |
| 4,402,619 | 9/1983 | Paque et al. | 400/613 |

*Primary Examiner*—Edgar S. Burr
*Assistant Examiner*—David A. Wiecking
*Attorney, Agent, or Firm*—Dorsey & Whitney

[57] ABSTRACT

A lettering apparatus adapted for receiving a replaceable tape supply cartridge comprising a pair of spaced apart, parallel frame members defining a cartridge receiving cavity and a print bar pivotally supported between the frame members. The apparatus also includes an improved linkage for generating the lettering force, an improved tape cut-off mechanism and improved means for driving the tape advancement mechanism in the cartridge. The cartridge also includes a device for sensing the amount of tape remaining and means for aligning the tape and characters to be lettered.

14 Claims, 21 Drawing Figures

148
149
150
151
152
154
155
156
158
159
160
161
162
50
49
55
11
86
106
84
85
82
115
100
105
47
44
40
41
108
36
39
30
112
101
13
27
23
24
26
32
66
64
65
68
70
69
31
20
104
54
109
46
114
48
102

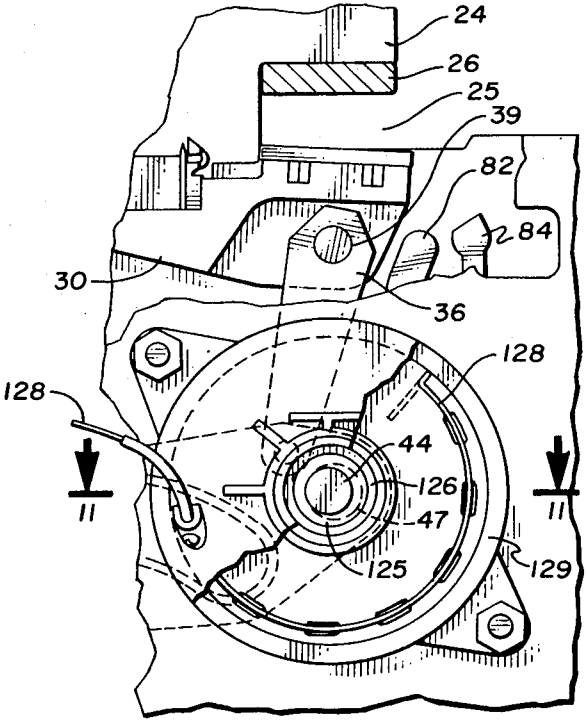
Fig. III
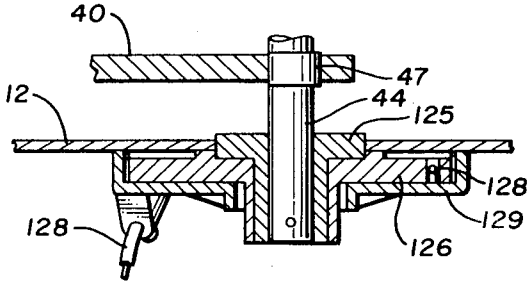
Fig. II
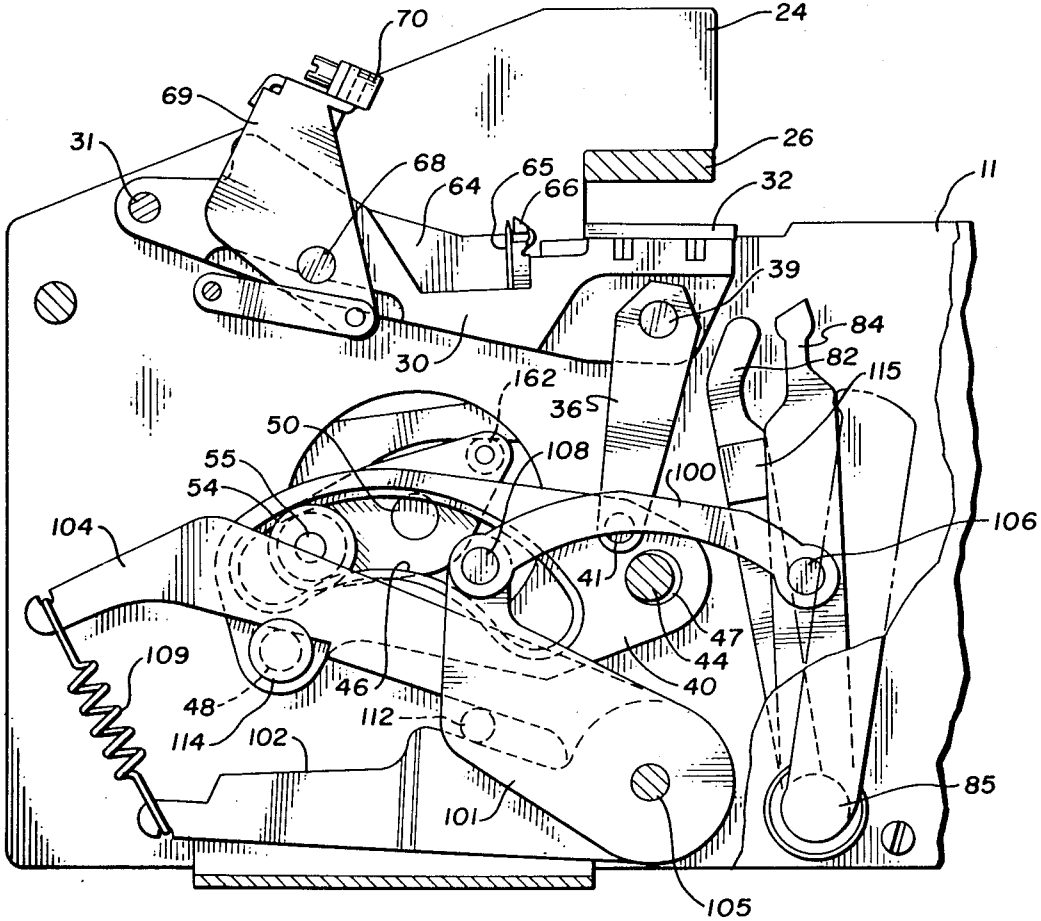
Fig. 4

LETTERING APPARATUS

This is a continuation of application Ser. No. 549,245, filed Nov. 4, 1983, now abandoned.

BACKGROUND OF THE INVENTION

The present invention relates generally to an improved lettering apparatus or type composing system, and more particularly, to an improved lettering apparatus or type composing system adapted for use with a replaceable tape supply cartridge for supplying lettering tape into alignment with a lettering station embodied within the apparatus.

The lettering apparatus of the present invention is of the type which includes a means for generating a lettering force at the lettering station, a means cooperating with advancement means within the tape supply cartridge for advancing the tape toward alignment at the lettering station and means commonly in the form of a rotatable font for providing a character to be lettered at the lettering station. It is contemplated that the apparatus of the present invention can be used in a lettering operation in which the cartridge contains a supply of image carrying tape and color carrying ribbon and in which an image of a raised character is transferred from the ribbon to the tape as a result of the exertion of the lettering force. It is also contemplated, however, that the apparatus of the present invention can be used with a system in which the tape includes a thin layer of adhesive-backed material from which the character in alignment with the lettering station is cut and then ultimately removed for placement onto the desired medium. It is contemplated that this latter procedure can be utilized either with or without a supply of protecting ribbon disposed between the tape and the character.

Several lettering systems of the general type described above are currently available. For example, one of these is described in U.S. Pat. No. 4,243,333 and is directed to an improved means for creating a printing force. Specifically, this means includes a plurality of link members and a roller for causing pivotal movement of a print bar to generate the printing force. This print generation means is disposed in a plane generally perpendicular to the plane in which the tape supply cartridge is disposed. Another example of a prior art lettering apparatus of this type is described in U.S. Pat. No. 4,402,619. Similar to the device described in U.S. Pat. No. 4,243,333, this device also includes a printing force generating means which comprises a plurality of link members which cause the pivoting of a print bar with respect to a frame of the apparatus. In this device, the printing force generating means is also disposed in a plane generally perpendicular to the plane of the tape supply cartridge.

Although the above referenced prior art lettering systems and others have functioned satisfactorily in various applications and for various purposes, there continue to be ways in which such apparatus can be improved. For example, the force generating mechanism can be improved so that it is more efficient, compact and responsive to the needs of the system. Further, improved features are needed for letter spacing, for aligning and advancing the tape and for properly positioning the rotatable font. Accordingly, there is a need in the art for a lettering apparatus which embodies such improved features.

SUMMARY OF THE INVENTION

The present invention relates generally to a lettering apparatus for use with a replaceable tape supply cartridge. More particularly, such apparatus includes a frame assembly comprising a pair of parallel frame members for supporting the force exerting mechanism and for housing the tape supply cartridge. With this structure, the tape supply cartridge is disposed in a plane which is generally parallel to the plane in which the force exerting mechanism is supported. The apparatus of the present invention also includes an improved means for generating the lettering force including a plurality of novel link elements for pivoting a print bar relative to the frame members and an improved force resisting mechanism. This force resisting mechanism includes a pair of overhanging portions of the frame members and a force resisting arm which is pivotable between an inoperative position in which the arm is disposed outside of the frame members and an operative position in which the arm is positioned beneath the overhanging portions of the frame members.

The lettering apparatus of the present invention also includes improved means for advancing the tape supply into alignment at the lettering station. This means includes an elongated stop arm adapted for engagement with a stop surface on the tape advancement assembly of the tape supply cartridge for limiting the forward advancement of the tape and a drive arm cooperating with the tape advancement assembly for advancing the tape. An improved kerning mechanism is also provided for facilitating the accurate spacing of various two character combinations. Such improved kerning mechanism embodies a kerning slide connected with one of the frame members and adapted for limited sliding movement during a lettering cycle to provide proper spacing for such character combinations. The kerning slide permits movement of the entire cartridge and tape advancing mean to adjust the character spacing.

The lettering apparatus of the present invention also includes a means for sensing the amount of tape remaining within the cartridge. This means includes a tape sensing element having a pair of roller members for engagement with the spool of tape within the cartridge. The sensing element extends through an opening in the bottom of the cartridge and is connected with a link member pivotably secured to one of the frame members of the machine. This link member in turn is connected with a device for providing visual indication of the amount of tape remaining in the cartridge. The device of the present invention is also provided with an improved means for properly aligning the font element with respect to the lettering station and an improved tape cut-off mechanism.

Accordingly, an object of the present invention is to provide an improved lettering apparatus of the type having a means for generating a lettering force, a means for housing a replaceable tape supply cartridge and a means for cooperating with the cartridge for advancing the tape into alignment at the lettering station.

Another object of the present invention is to provide a lettering apparatus having an improved force generating means supported between a pair of frame members in a plane generally parallel to the tape supply cartridge and which includes an improved force resisting arm.

Another object of the present invention is to provide a lettering apparatus having an improved tape advancement and spacing mechanism.

A further object of the present invention is to provide a lettering apparatus for use with a tape supply cartridge which includes means for sensing, and providing visual indication of, the remaining tape within the cartridge.

Another object of the present invention is to provide a lettering apparatus with improved means for adjusting the lettering force.

Another object of the present invention is to provide a lettering apparatus with an improved kerning mechanism comprising a kerning slide and a means for moving the entire cartridge and advancement mechanism rearwardly during the kerning operation.

A still further object of the present invention is to provide a lettering apparatus with an improved tape cut-off feature and an improved means for properly aligning the lettering font.

These and other objects of the present invention will become apparent with reference to the drawings, the description of the preferred embodiment and the appended claims.

DESCRIPTION OF THE DRAWINGS

FIG. 7 is a side elevational view of the lettering apparatus of the present invention taken inside the left frame member, with parts cut away. This view is at the maximum force generating portion of the lettering cycle.

FIG. 9 is a side elevational view of the lettering apparatus of the present invention taken inside the left frame member, with parts cut away. This view is nearing completion of the lettering cycle.

FIG. 10 is a side elevational fragmentary view of the eccentric mechanism for adjusting the lettering pressure.

FIG. 17 is a side elevational fragmentary view of the kerning slide and associated mechanism in its rearward or kerning position.

DESCRIPTION OF THE PREFERRED EMBODIMENT

Figure 1:
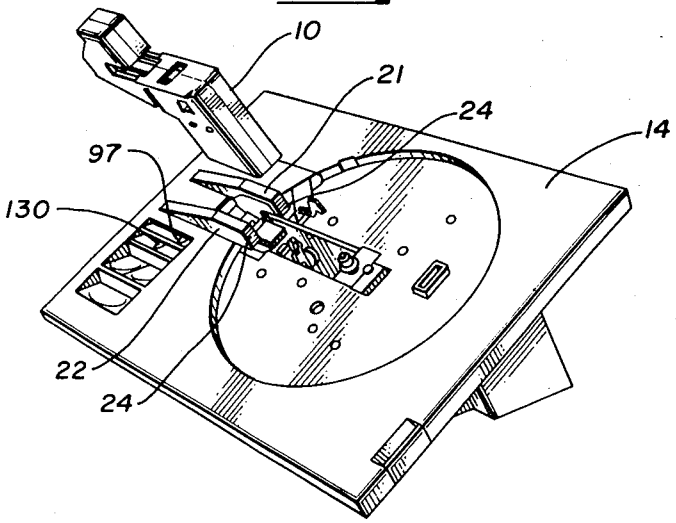
FIG. 1 is a pictorial view of the lettering apparatus of the present invention showing the tape supply cartridge projected out from the cartridge receiving cavity.
Figure 2:
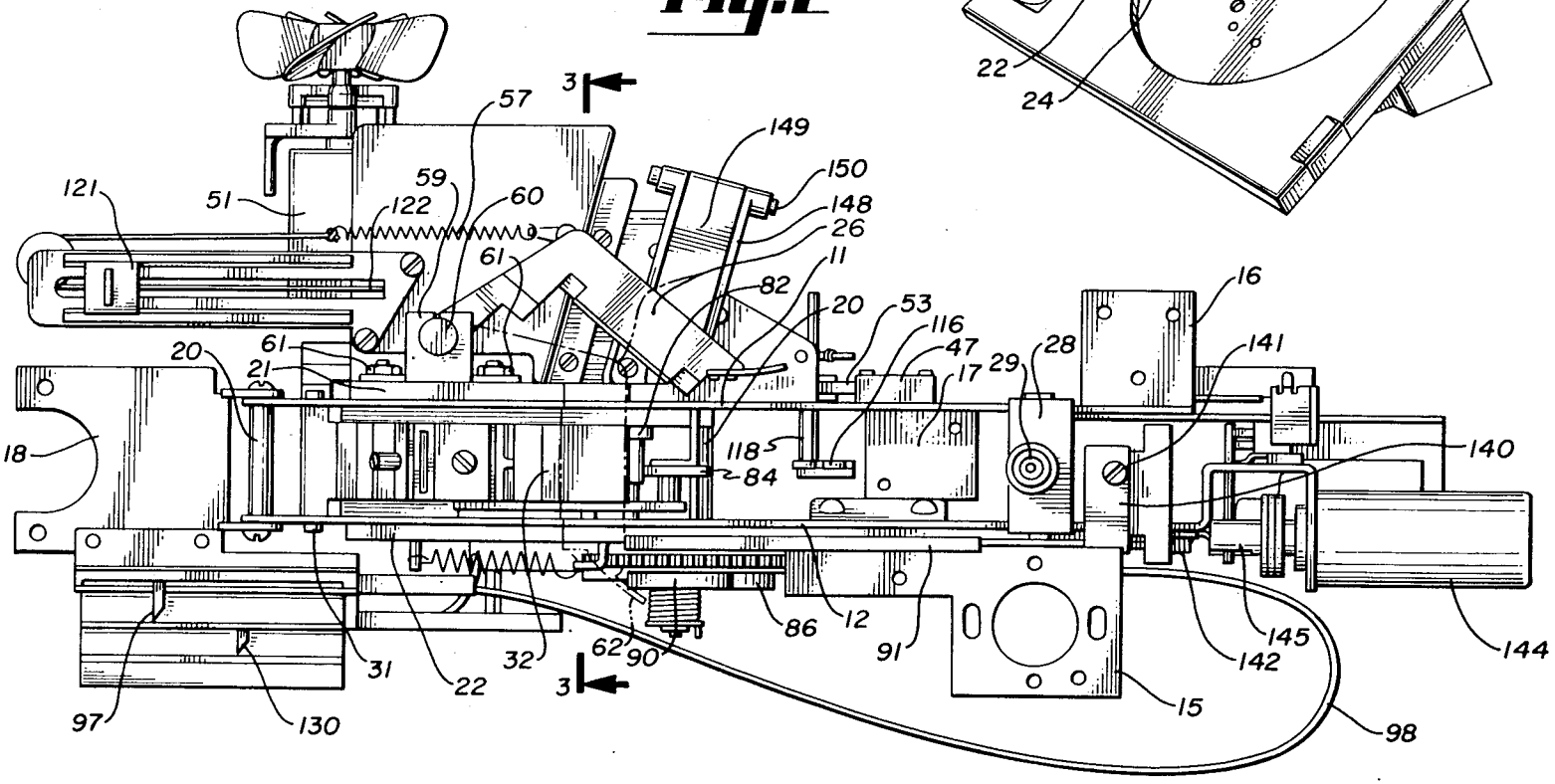
FIG. 2 is an elevational top view of the lettering apparatus of the present invention with the tape supply cartridge removed.
Figure 3:
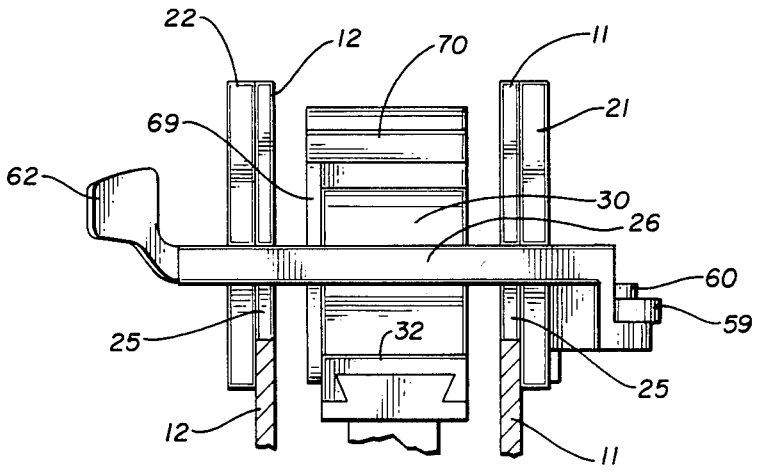
FIG. 3 is a view, partially in section, as viewed along the section line 3—3 of FIG. 2, with the force resisting arm in its operative position and with parts removed.

As illustrated best in FIGS. 1 and 2, the lettering apparatus of the present invention includes a housing 14 and a main frame assembly. The main frame assembly houses a tape supply cartridge 10 within a cartridge receiving cavity and supports various other operative mechanisms within the apparatus. Specifically, the frame assembly includes a pair of spaced apart frame members 11 and 12 which lie in planes generally parallel to one another. The two parallel frame members 11 and 12 are securely mounted with respect to the main apparatus housing 14 by a plurality of mounting brackets 15, 16, 17 and 18. The frame members 11 and 12 are maintained in a rigid, spaced relationship by a plurality of spacing elements 20. Positioned near the top of each of the frame members 11 and 12 is a reinforcement plate 21 and 22, respectively. The plates 21 and 22 are connected with the frame members 11 and 12 by threaded members, welding, or other appropriate means and provide the frame assembly with reinforcement to resist the lettering force.

As will be described in greater detail below and as illustrated best in FIGS. 1, 3, 4, 7 and 9, the upper portion of the frame assembly in the area of the reinforcement plates 21 and 22 includes overhanging portions 24 spaced from the main portion of the frame by the recessed area 25. These overhanging portions 24 each include a support surface 33 (FIG. 14) to provide support for a force resisting arm 26 to resist movement of a print bar 30 and thus create the lettering force. During a lettering cycle, the print bar 30 and surface 32 move upwardly toward the arm 26 with a tape 13, ribbon 27 and font element 23 disposed in the recessed area between the arm 26 and surface 32. The rearward ends of the frame members 11 and 12 are provided with a bracket 28 for supporting a font rotation post 29 (FIG. 2).

Figures 4, 5, 6:
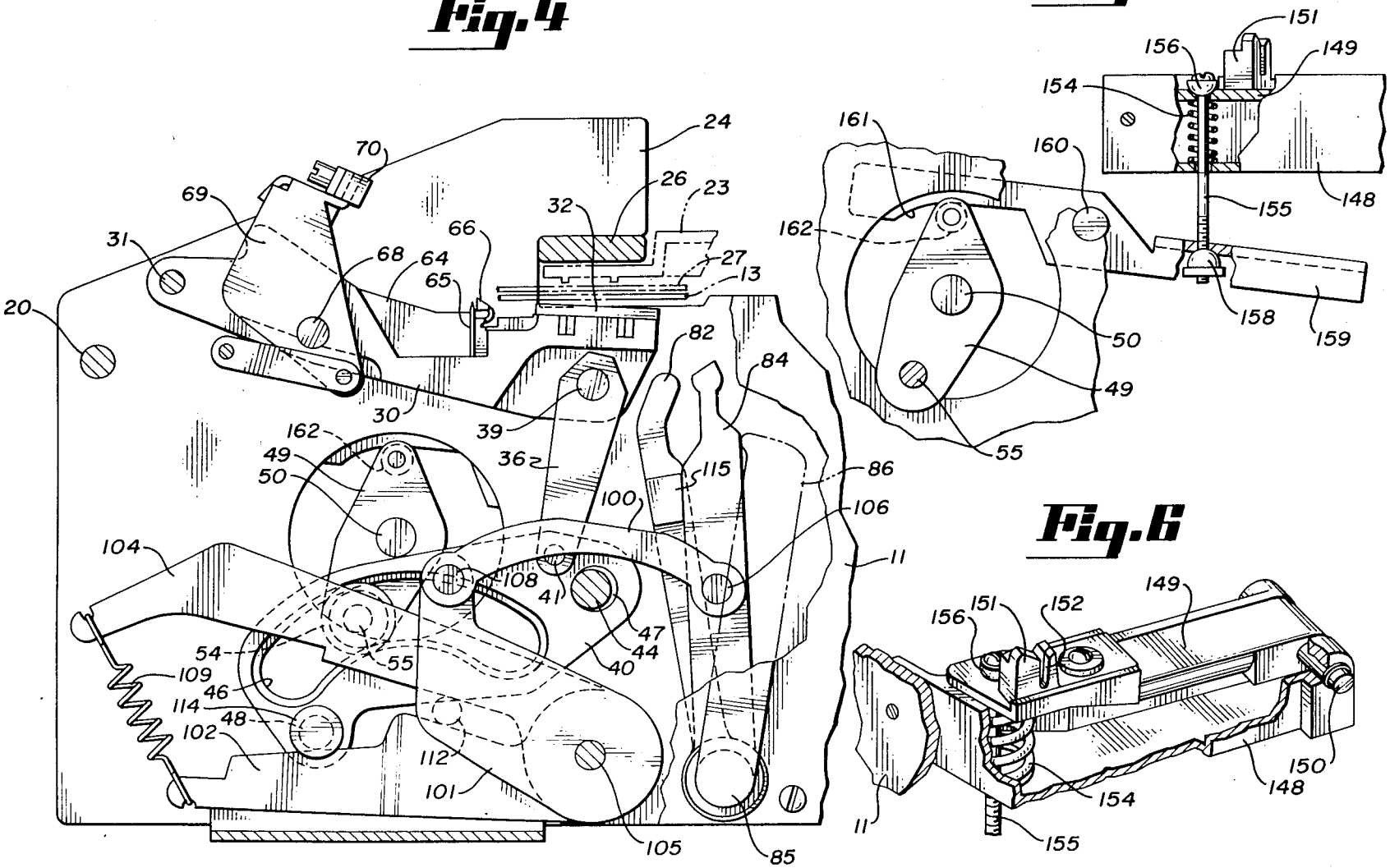
FIG. 4 is a side elevational view of the lettering apparatus of the present invention taken inside the left frame member, with parts cut away. This view is just prior to the commencement of a lettering cycle.
FIG. 5 is a side elevational fragmentary detail of the means for insuring proper alignment of the lettering font in the same position of the lettering cycle as FIG. 4.
FIG. 6 is a fragmentary pictorial view of the means for insuring proper alignment of the lettering font, with parts cut away.
Figure 12:
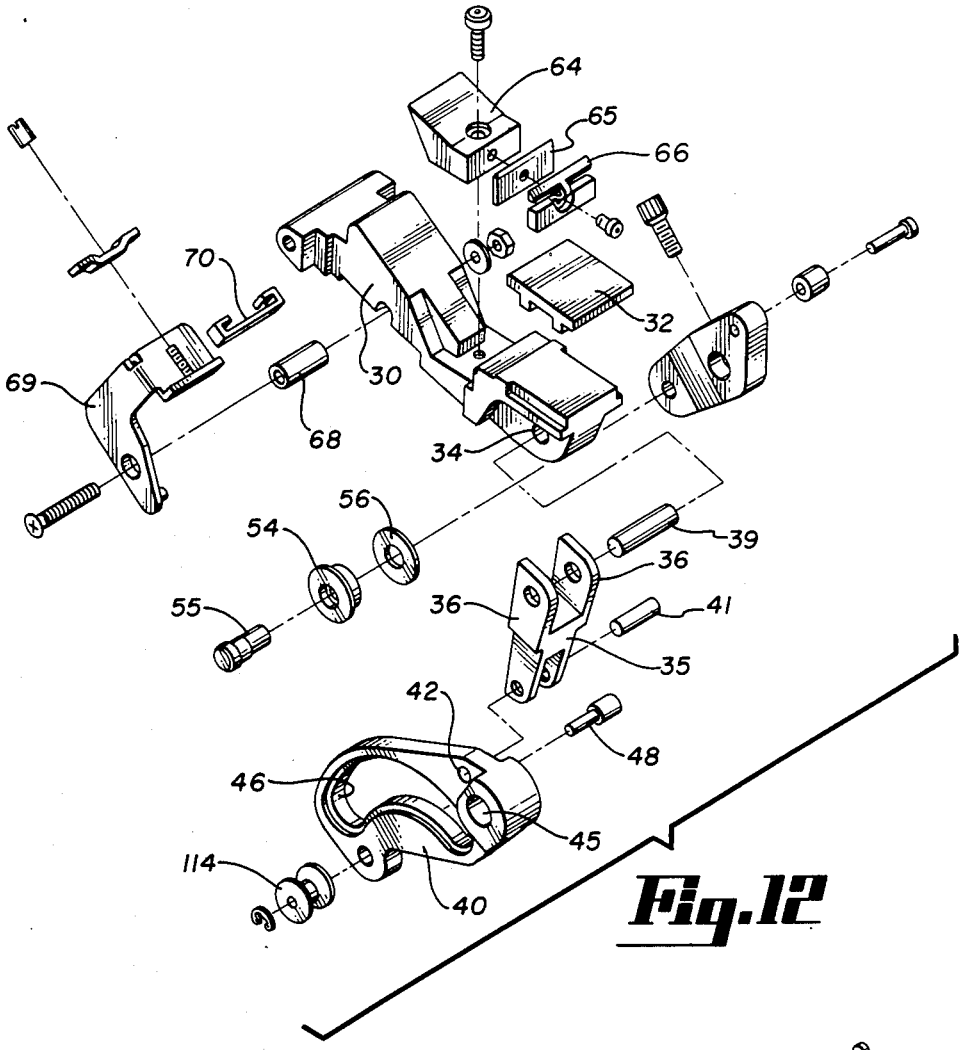
FIG. 12 is a pictorial, exploded view showing the elements comprising the force generation means and a portion of the tape cut-off mechanism.

The means for generating the lettering force is illustrated best in FIGS. 4, 7, 9 and 12. FIG. 12 is a pictorial, exploded view of the various force generating elements while FIGS. 4, 7 and 9 show such elements at various positions during a lettering cycle. The force generating means includes an elongated print or lettering bar 30 which is pivotally secured at one of its ends between the frame members 11 and 12 about the pivot 31. The pivot 31 extends generally perpendicular to the frame members 11 and 12. The other end of the lettering bar 30 is provided with a force generating surface 32. In the preferred embodiment, this surface 32 is comprised of a polyurethane or other similar material. During a lettering cycle, the print bar 30 is caused to pivot about the pivot 31 so as to generate the lettering force. The end of the print bar 30 near the surface 32 is provided with a laterally extending opening 34 for connection with a force transfer link 35. The link 35 includes a pair of spaced apart flanges 36, 36 with openings 38, 38 for pivotal connection with the opening 34. A pivot pin 39 extends through the openings 34 and 38 to pivotally secure the transfer link 35 to the print bar 30. The other end of the transfer link 35 is pivotally secured to a portion of a pivot link member 40 by the pivot pin 41 extending through the opening 42. The link 40 is pivotally secured between the frame members 11 and 12 about a pivot shaft 44 (FIGS. 4, 7 and 9) extending through the opening 45 (FIG. 12) and provided with an eccentric bushing 47. The link 40 is also provided with a closed loop force transfer surface 46 and a motion transfer pin 48 supporting a roller 114.

The force generating means also includes a rotatable member 49 which is directly connected with the shaft 50 for rotation therewith. The shaft 50 is in turn driven by a motor 51 (FIG. 2). The member 49 includes an opening 52 to which a flanged roller 54 is secured by the pivot pin 55. A washer 56 is positioned between the roller 55 and the member 49. When assembled, the roller 55 is adapted for rolling, motion transferring engagement with the irregularly shaped opening 46 as the member 49 rotates on the shaft 50. The opening 46 is configured so as to provide the mechanical advantage needed to create the lettering force.

During a lettering cycle, the rotating member 49 driven by the shaft 50, is caused to rotate one revolution. This movement in turn causes pivotal movement of the link 40 about the shaft 44 as a result of engagement between the roller 54 and the surface 46. The pivotal movement of the link 40 in turn transfers movement via the transfer link 35 to the force generating end of the lettering bar 30. This upward movement of the lettering bar 30 about its pivot 31 during a lettering cycle creates a lettering force or pressure between the surface 32 and the force resisting arm 26. The sequential movement of the various link and other members of the force generating means at various points during a lettering cycle is shown in FIGS. 4, 7 and 9.

Figure 11:
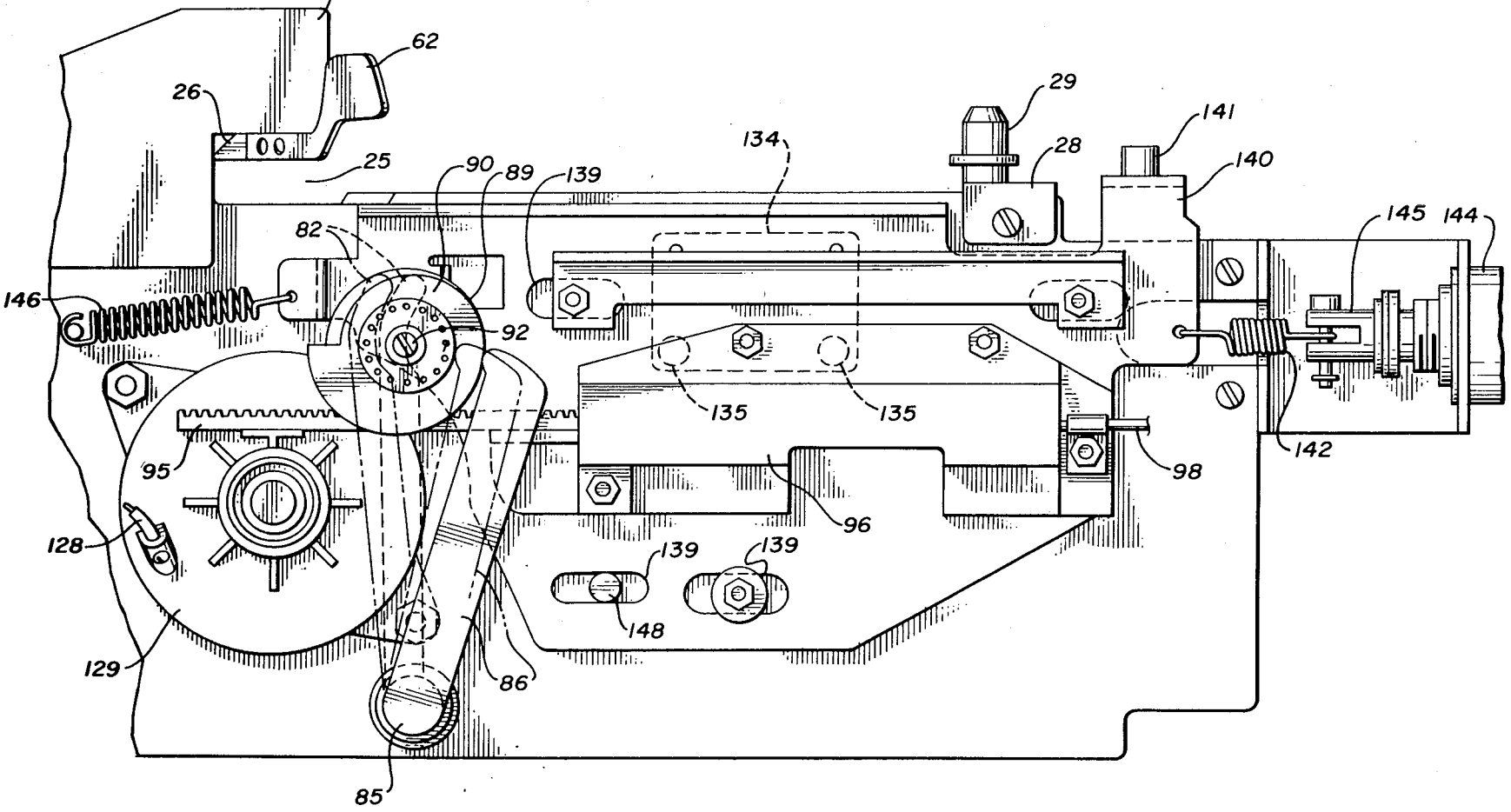
FIG. 11 is a view, partially in section, as taken along the section line 11—11 of FIG. 10.

As illustrated best in FIGS. 10 and 11, the apparatus also includes means for varying or adjusting the lettering force. In the preferred embodiment, this means includes the provision of an eccentric bushing 47 mounted on the shaft 44 which pivotally supports one end of the link 40. As the shaft 44, and thus the bushing 47, is rotated, the position of the pivotal support for the eccentric link 40 is changed. This in turn varies the permitted vertical movement of the print bar 30 and pad 32 during a lettering cycle. Such variance in permitted vertical movement results in greater or lesser lettering force being generated during a lettering cycle. For example, as the bushing 47 is rotated so as to raise the pivot point of the link 40, the lettering force will be increased. Conversely, as the bushing 47 is rotated so as to lower the pivot point supporting the link 40, the lettering force will be decreased. Rotation of the bushing 47 and thus vertical adjustment of the shaft 44 is controlled by a cable assembly. The cable assembly includes a hub 125 and flange portion 126 connected to the shaft 44 for pivotal movement therewith. A cable 128 has one end connected with the flange 126 and its other end connected with an actuator 130 (FIGS. 1 and 2) on the housing. This structure facilitates selective rotational movement of the bushing 47 to vary the lettering force. The cable assembly is disposed within a housing 129 connected with the frame member 12.

Also forming part of the force generating means is the means for resisting movement of the print bar 30. This means is illustrated best in FIGS. 2 and 3 and includes the force resisting arm 26 which is pivotally secured to a force resisting bracket 59 about the pivot pin 60. The bracket 59 is securely connected with the frame member 11 and the reinforcing plate 21 by a pair of threaded connecting members 61, 61. The force resisting arm 26 is pivotable about the pin 60 between an inoperative position as illustrated by the solid lines in FIG. 2 and an operative position illustrated by solid lines in FIG. 3 and by the phantom lines in FIG. 2. When in its operative position, the upper surface of the force resisting arm 26 is engaged with the downwardly facing support edges or surfaces 33 (FIG. 14) of the overhanging portions 24. In the preferred embodiment, these support surfaces 33 are defined in part by the frame members 11 and 12 and in part by the reinforcing plates 21 and 22. The outer end of the force resisting arm 26 is provided with a gripping tab 62 to facilitate manual movement of the arm 26 between its operative and inoperative positions. In the preferred embodiment, the arm 26 is provided with detent means at both ends of its movement so that the arm 26 cannot be inadvertently moved from either its inoperative or its operative position without manually doing so. When in its operative position, the force resisting arm 26 extends laterally, at generally right angles, with respect to the parallel planes of the frame members 11 and 12.

Figure 14:
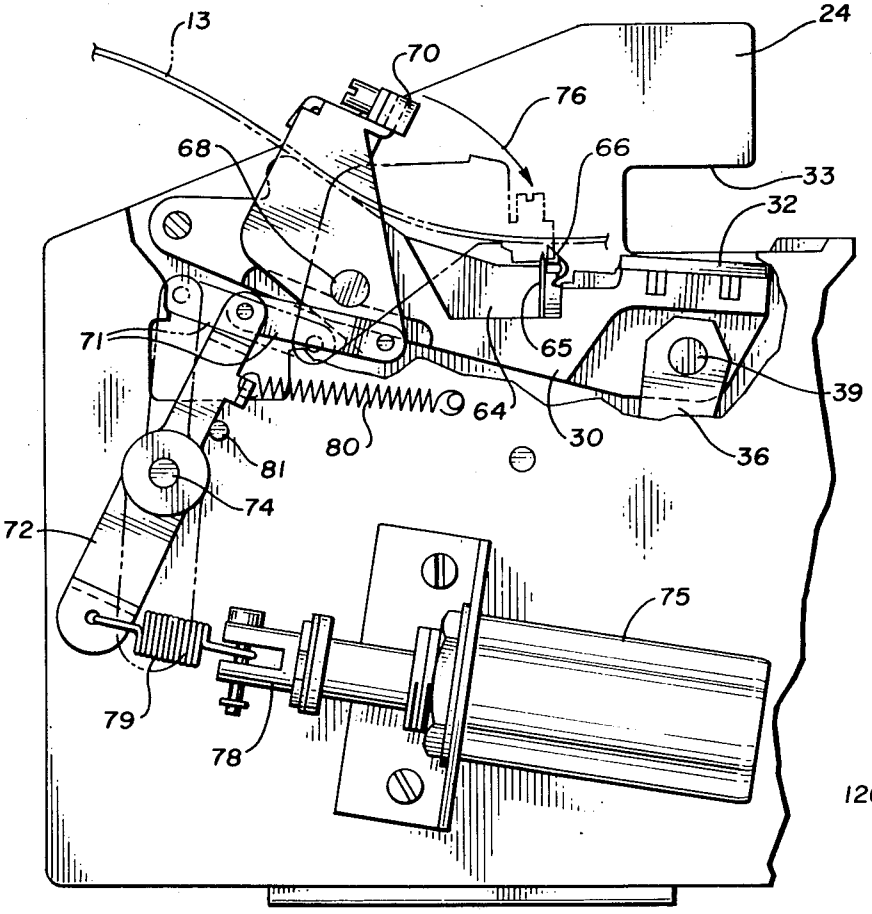
FIG. 14 is a side elevational fragmentary view of the cut-off mechanism of the present invention as viewed inside the left side frame member, with parts removed.

A tape cut-off feature is illustrated best in FIGS. 12 and 14. Connected with an upper surface of the print bar 30 is a tape cut-off support member 64 provided with a cut-off edge 65. Disposed to the rearward side of the cut-off edge 65 is a tape shield 66 for protecting the tape 13 when the cut-off feature is not being utilized. Pivotally secured to the lettering bar 30 about the pivot 68 is a cut-off link 69. One end of this link 69 is provided with a cut-off pad 70 for movement toward the cut-off edge 65. The other end is connected with a force transfer link 71 which is pivotally secured to an actuating toggle linkage 72. The linkage 72 is pivotally secured to the frame member 12 about the pivot 74 and includes an end which is connected to a cut-off solenoid 75. Upon actuation of the solenoid 75, the actuating linkage 72 is caused to pivot counterclockwise about its pivot point 74. This in turn imparts movement through the transfer link 71 to the cut-off link 69 in the direction of the arrow 76 in FIG. 14. As a result, the cut-off pad 70 moves downwardly toward the cut-off edge 65, thereby cutting off or severing the tape 13. The solenoid 75 is connected to the actuating link 72 via the solenoid plunger 78 and the spring 79. When the solenoid plunger 78 is released, the link 72 is returned to its normal rest position (illustrated by the solid lines in FIG. 14) by the spring 80. The spring 80 is connected between a portion of the frame member 12 and a portion of the link 72. Movement of the link 72 toward its rest position is limited by the stop member 81.

Figure 21:
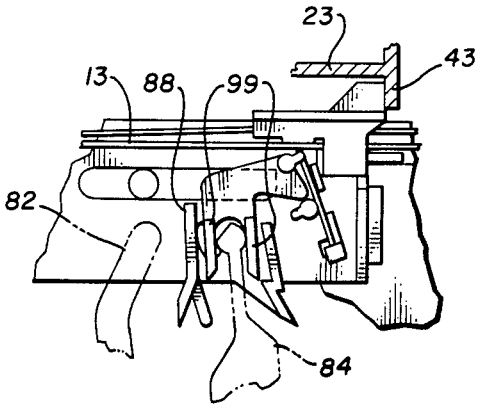
FIG. 21 is an elevational fragmentary side view showing the relationship between the apparatus stop arm and drive arm and the tape advancement means of the tape supply cartridge.

The means for advancing the tape 13 within the cartridge 10 is illustrated best in FIGS. 1, 4, 7 and 21. In the preferred embodiment, this means includes a stop arm 82 and a drive arm 84. Both the stop and drive arms 82 and 84 are pivotally secured about the pivot member 85 which extends between and generally perpendicular to the frame members 11 and 12. The stop arm 82, which is independently pivotable from the drive arm 84 is rigidly connected with, and therefore pivotally movable with, a letter spacing arm 86. The stop arm 82 is an elongated member extending upwardly from the pivot point 85 and including an upper stop arm end adapted for engagement with a portion of the tape supply cartridge for limiting advancement of the tape 13 within the cartridge. In the preferred embodiment, as shown in FIG. 21, the upper end of the stop arm 82 is adapted for engagement with a stop or limit surface 88 of a shuttle assembly for limiting the forward movement of such assembly and therefore advancement of the tape 13.

Figure 16:
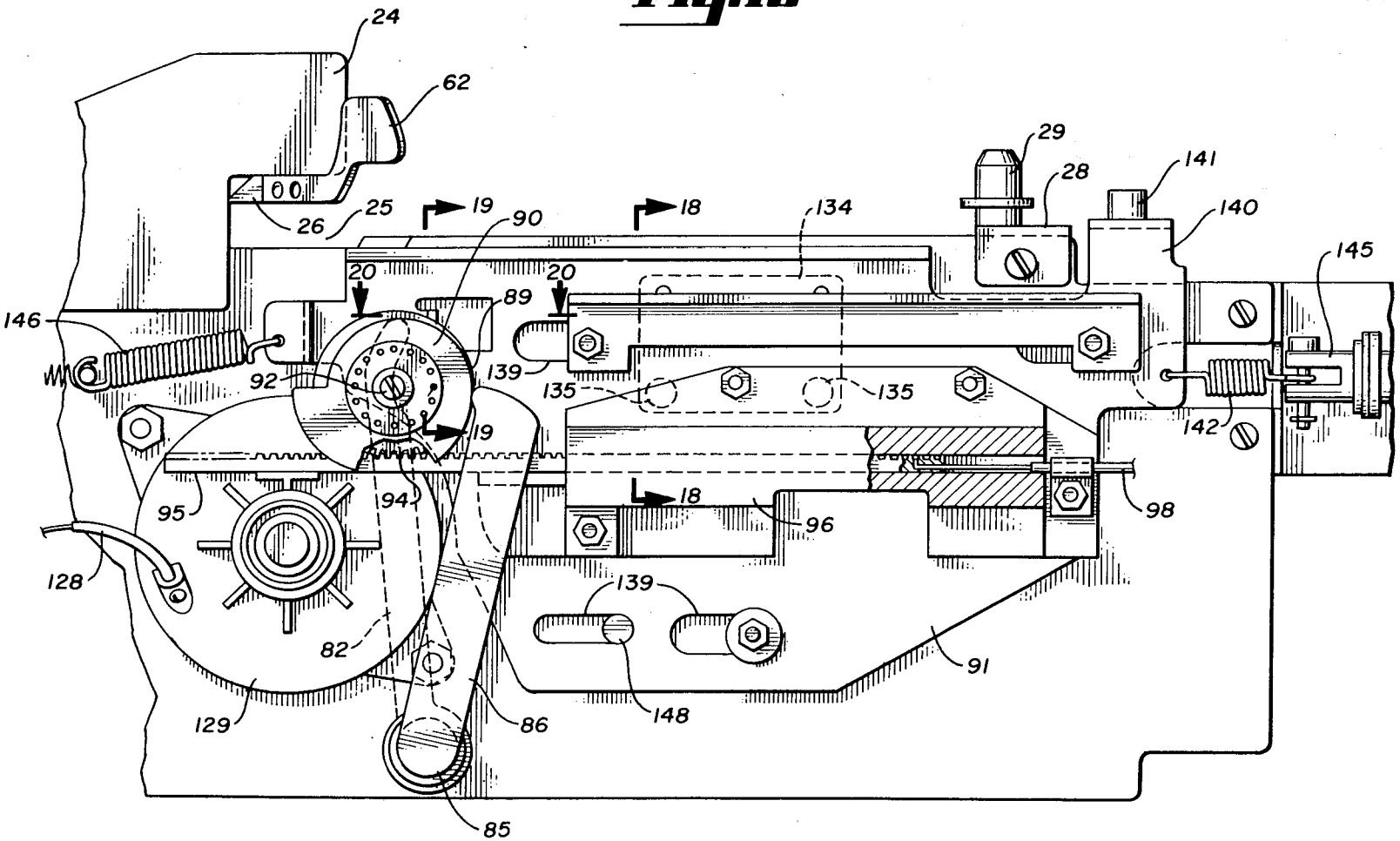
FIG. 16 is a side elevational fragmentary view of the kerning slide and associated mechanism in its forward position.

The limiting position of the stop arm 82 is in turn defined by the corresponding position of the letter spacing arm 86. As illustrated best in FIGS. 16 and 17, the lower end of the spacing arm 86 is pivotally secured with respect to the pivot 85 for common pivotal movement with the stop arm 82, while the upper end is adapted for engagement with a cam surface 89 of the cam member 90. The cam member 90 is rotatably secured with respect to the kerning slide 91 about the pivot 92. Rotation of the cam member 90 about the pivot 92 causes pivotal movement of the spacing arm 86 because of engagement between the upper end of the arm 86 and the cam surface 89. This pivotal movement of the spacing arm 86 results in similar pivotal movement of the stop arm 82, thus defining the stop position for advancing the tape 13 within the cartridge 10. The cam member 90 is connected with a toothed gear 94 which in turn is operatively associated with the toothed rack 95 mounted for sliding movement within the slide member 96. The slide member 96 is secured to the kerning slide 91 by appropriate connecting means. Movement of the toothed rack 95 is driven by a cable assembly 98 which is controlled by movement of an appropriate tab 97 connected with the apparatus housing 14 (FIG. 1). Lateral movement of the toothed rack 95 results in corresponding rotational movement of the cam element 90. This in turn causes pivotal movement of the spacing arm 86 and stop arm 82 to define the desired stop position. By adjusting the stop position of the arm 82, the letter spacing can be adjusted.

The drive arm 84 is also pivotally secured to the pivot 85 but, except for engagement between the arm 84 and a laterally extending portion 115 of the arm 82, is movable independent of the stop arm 82. The drive arm 84 includes an upper drive arm end which is adapted for driving engagement with a drive arm receiving cavity within the tape supply cartridge. In one embodiment illustrated in FIG. 21, this cavity is defined by the pair of drive tabs 99. The means for causing pivotal movement of the drive arm 84 about the pivot 85 is shown best in FIGS. 4, 7, 9 and 16. Such means includes the link members 100, 101, 102 and 104. Each of the link members 101, 102 and 104 is adapted for pivotal movement about the pivot 105 between the frame members 11 and 12. The link member 100 includes one end which is pivotally secured to a portion of the drive arm 84 about the pivot 106 and a second end which is pivotally secured to a portion of the link 101 about the pivot 108. The link members 102 and 104 are pivotally secured at one end between the frame members 11 and 12 about the pivot 105 with their opposite ends being connected to, and biased together by, an extension spring member 109. The spring 109 is connected at its ends to the outer ends of the links 102 and 104. Each of the links 102 and 104 is provided with a pair of force transfer surfaces 110 and 111. The force transfer surface 111 of each of the links 102 and 104 is adapted for engagement with an outwardly extending post 112 on the link 101, while the force transfer surface 110 of each of the links 102 and 104 is adapted for engagement by a roller member 114 pivotally secured to the post 48 on the link 40.

During revolution of the rotational member 49, and thus pivotal movement of the link 40, the roller 114, through engagement with the surfaces 110, 110, causes corresponding movement of the link members 102 and 104. This movement in turn is transferred to the link member 101 as a result of engagement between the post 112 and the surfaces 111, 111. Pivotal movement of the link 101 in turn is transferred via the force transfer link 100 to the drive arm 84. It should be noted that the spring 109 connected with the outer ends of the links 102 and 104 provides an override feature for the arm 84 in both directions. In other words, if movement of the drive arm 84 is limited, in either a rearward or a forward direction, the machine will continue to cycle, with the only consequence being the stretching of the spring member 109. Such override will usually occur during a normal lettering cycle. During such cycle, rearward movement of the drive arm 84 will be limited by means within the cartridge such as the spacing ring 43 (FIG. 21). Forward movement of the drive arm 84 is limited as a result of engagement between the drive arm 84 and the laterally extending portion 115 of the stop arm 82. Thus, in a normal lettering cycle, it is contemplated that there would be need for a override at each end.

Figure 15:
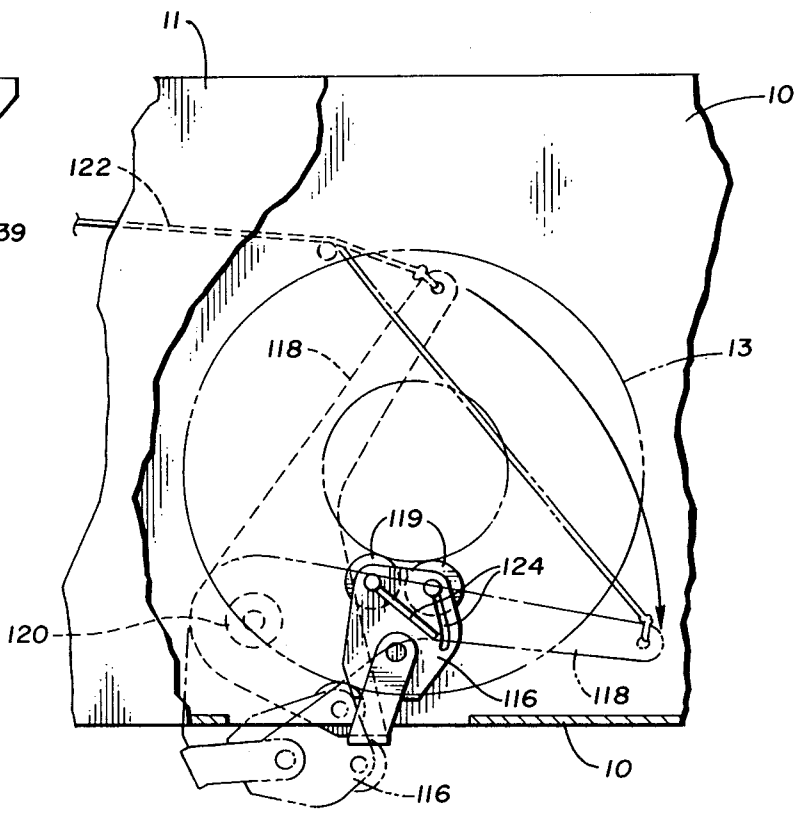
FIG. 15 is a side elevational fragmentary view of the mechanism of the present invention for sensing the amount of tape remaining within the tape supply cartridge as viewed inside the left side frame member.

The lettering apparatus of the present invention is also provided with a means for sensing the amount of tape remaining in an inserted cartridge. This means is illustrated best in FIGS. 2 and 15 and includes a tape sensing element 116 mounted on one end of a tape sensing linkage 118. A pair of metal rollers 119, 119 are rotatably secured to an upper end of the element 116 for engagement with the tape supply 13 within the cartridge 10. The linkage 118 is pivotably secured to the frame member 11 about the pivot point 120. An opposite end of the linkage 118 is connected with a tape indicator 121 (FIG. 2) on the housing by a string 122 or other means for transferring movement of the linkage 118 to the indicator 121. In the preferred embodiment, the indicator 121 is visually observable. A switch 47 is also mounted on the outer surface of the frame member 11. This switch 47 includes a switch element 53 which is engageable by a portion of the linkage 118. A spring 57 is connected with the end of the string 122 to bias the linkage 118 in a counterclockwise direction about the pivot 120 as viewed in FIG. 15. When no cartridge is in the cavity, the linkage 118 and sensing element 116 are in the positions illustrated by the broken lines and solid lines, respectively, in FIG. 15. When in this position, engagement between a portion of the linkage 118 and the switch element 53 deactivates the entire system, thereby preventing a cycling of the machine.

Figure 13:
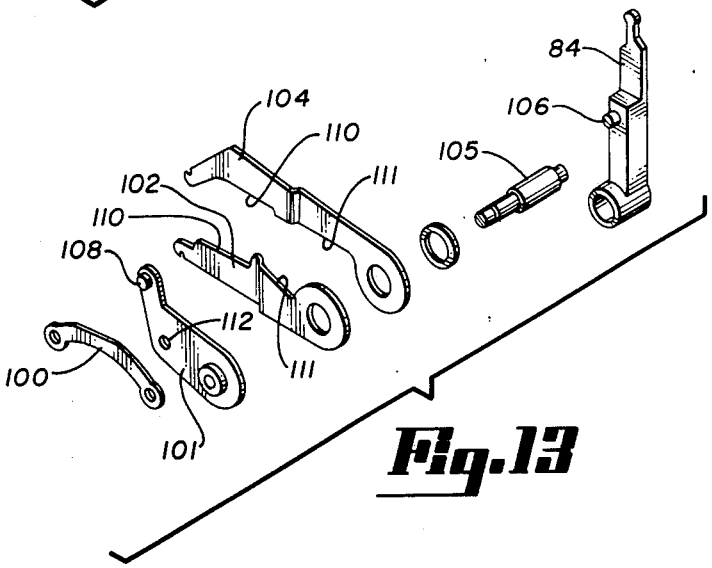
FIG. 13 is a pictorial, exploded view showing the elements for causing movement of the tape drive arm.

When a cartridge 10 is introduced into the cartridge receiving cavity formed between the frame members 11 and 12, the roller members 119 engage the remaining tape 13 within the cartridge. As a result of such engagement the element 116 will be moved downwardly and the linkage 118 will be pivoted in a clockwise direction as viewed in FIG. 13. This downward movement releases the switch element 53 to allow activation of a lettering cycle. Such movement also results in the indicator 121 reflecting the amount of tape remaining in the cartridge 10. As the tape 13 within the cartridge is used, the linkage 118 will pivot in a counterclockwise direction as the element 116 and rollers 119 move upwardly into the cartridge. This movement in turn results in the indicator moving toward the end indicating exhaustion of the tape supply. In the preferred embodiment, the rollers 119, 119 are constructed of a conductive metal and are electrically connected to respective electrical conductor elements 124, 124. These conductors are in turn connected with an appropriate electronic sensing mechanism. It is contemplated that the end of the tape supply will be provided with a piece of metal foil. Thus, when the rollers 119, 119 contact the metal foil at the end of the tape, an electrical circuit will be closed, thus actuating a visual or audio signal to advise the user that there are only a few inches of tape remaining to be used. This will enable the user to finish the word which he or she is lettering before inserting a new cartridge.

Figure 19:
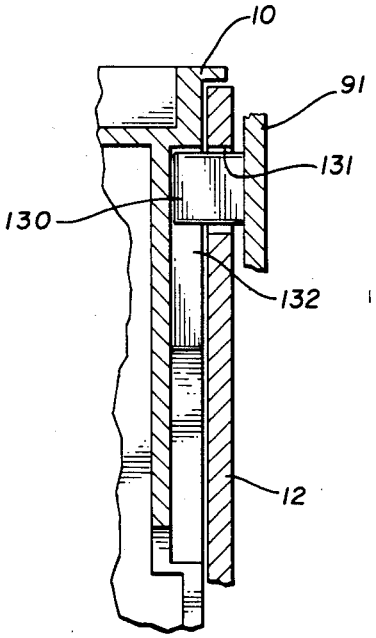
FIG. 19 is a view, partially in section, as viewed along the section line 19—19 of FIG. 16 with a cartridge in the cavity.
Figure 18:
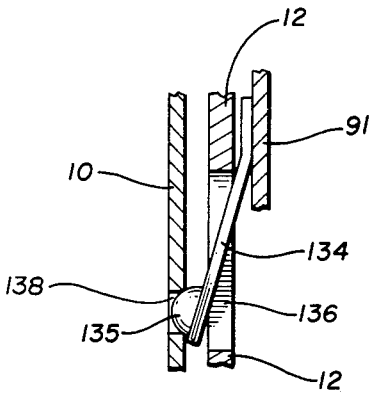
FIG. 18 is a view, partially in section, as viewed along the section line 18—18 of FIG. 16 with a cartridge in the cavity.
Figure 20:
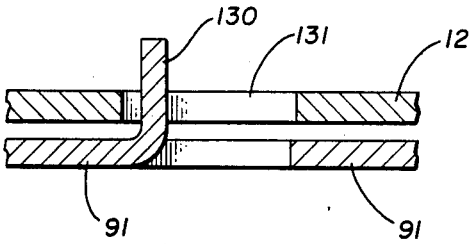
FIG. 20 is a view, partially in section, as viewed along the section line 20—20 of FIG. 16 with no cartridge in the cavity.

The means for providing proper spacing for certain letter combinations and for properly aligning the cartridge 10 is illustrated best in FIGS. 16, 17, 18, 19 and 20. This means includes a kerning assembly comprising a kerning slide 91 which is mounted for sliding movement with respect to the frame member 12. As illustrated in FIGS. 19 and 20, the kerning slide 91 includes an alignment tab member 130 which extends inwardly through an opening 131 in the frame member 12. The tab 130 extends inwardly past the inner surface of the frame member 12 for appropriate engagement with an alignment notch 132 on the cartridge 10. The slide 91 also includes an alignment spring member 134 (FIGS. 16, 17 and 18) having a pair of alignment members 135, 135 on its inner surface. This spring member 134 comprises a plate spring member which is connected with the inner side of the kerning slide 91 and extends inwardly into the cartridge receiving cavity through an opening 136 in the frame member 12. The alignment members 135, 135 are adapted for engagement with corresponding alignment openings 138, 138 in a side wall of the cartridge 10. The alignment elements 135, 135 not only assure proper vertical and horizontal alignment of the cartridge 10 with respect to the frame members 11 and 12 but also biases the cartridge 10 toward the frame element 11. This facilitates proper alignment of the cartridge 10 during a lettering cycle. It should be noted that the inner surface of the frame member 11 is preferably provided with a plurality of wear tabs or elements for engagement with the side wall of the cartridge 10.

The kerning slide 91 includes a plurality of elongated openings 139 to permit the slide 91 to be slideably connected with the frame member 12. The rearward end of the kerning slide 91 includes a kerning bracket 140 and a kerning post 141 for appropriate engagement with a kerning ring on the inside surface of the lettering font. Also connected with the rearward end of the kerning slide 91 is a spring member 142 having its outer end connected with a kerning solenoid 144. It can be seen that actuation of the solenoid 144 will cause the solenoid plunger 145 to move toward the right as viewed in FIG. 16, thus causing corresponding movement of the kerning slide 91 to the position illustrated in FIG. 17. Such movement, however, is limited as a result of engagement by the kerning post 141 with the kerning ring on an inside surface of the font. Following actuation of the solenoid 144, the force is released and the kerning slide 91 is returned to its rest position as a result of the spring member 146. The spring 146 is connected between an end of the slide 91 and a portion of the frame member 12. The normal or rest position of the kerning slide is defined by engagement between the limiting post 148 and a portion of the corresponding opening 139. It should be noted that the cam member 90 is mounted on the kerning slide 91; thus, rearward movement of the slide 91 will result in corresponding clockwise pivotal movement of the spacing arm 86 and thus rearward movement of the stop arm 82. Also, as a result of engagement between the portion 115 of the stop arm 82 and the drive arm 84, rearward pivotal movement of the stop arm 82 results in corresponding movement of the drive arm 84. Thus, rearward movement of the kerning slide 91 results in corresponding rearward movement of the entire cartridge as well as rearward movement of the stop arm 82 and the drive arm 84.

Figures 1, 8:
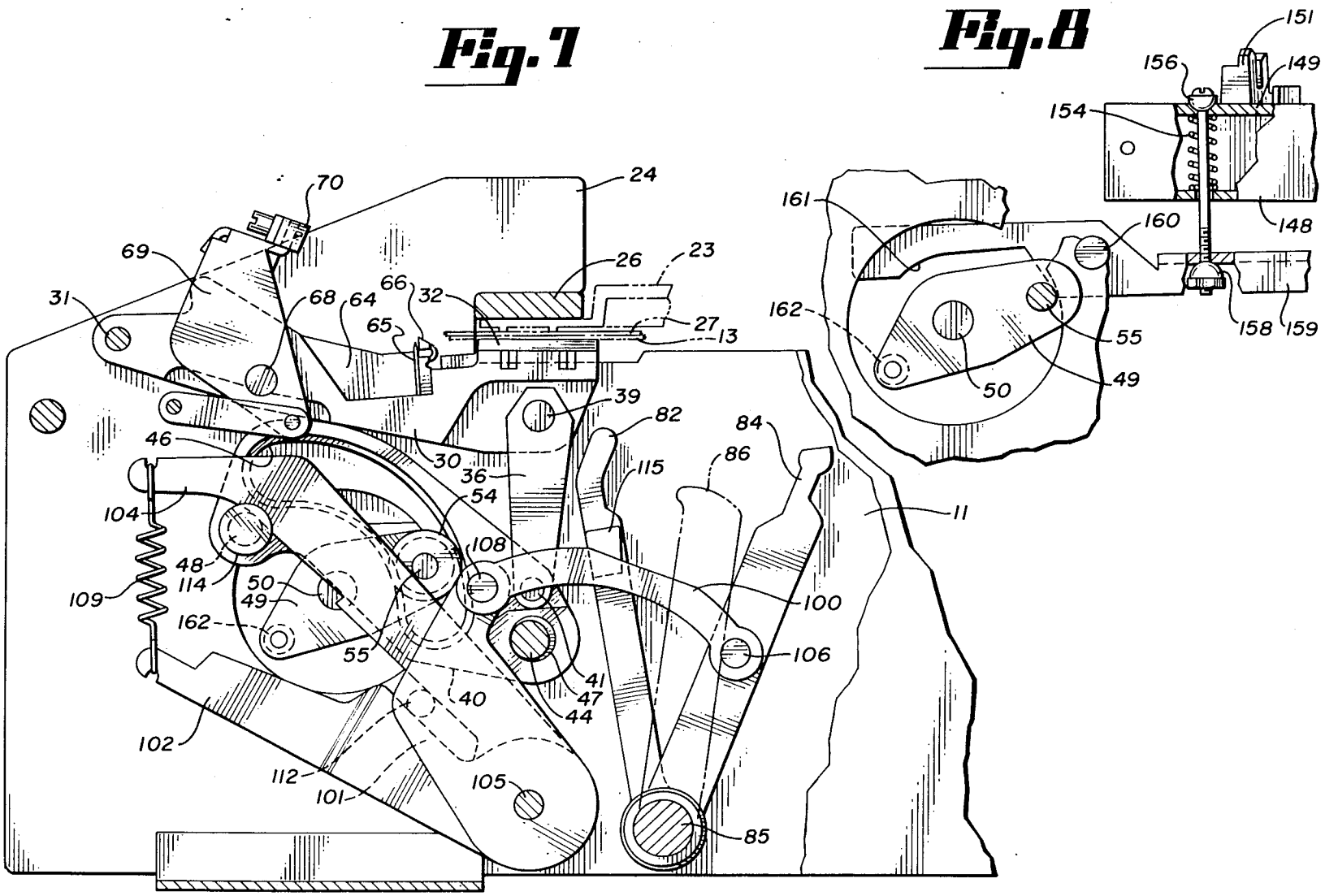
FIG. 8 is a side elevational fragmentary detail of the means for insuring proper alignment of the lettering font at the same position of the lettering cycle as FIG. 7.

The means for insuring proper alignment of the font during the printing cycle is illustrated best in FIGS. 5, 6 and 8. This means includes a housing portion 148 connected with the frame member 11 and a pivot arm 149 pivotally secured to an outer end of the housing 148 about the pivot 150. An alignment tab 151 having an alignment notch 152 is connected with a top surface of the arm 149 for engagement with an alignment rib on the font 23 (FIGS. 4 and 7). The arm 149 is biased upwardly relative to the housing 148 by the compression spring 154. An elongated member 155 extends through the spring 154 and has a head 156 engaging a portion of the arm 149. The other end of the member 155 extends through an opening in the housing 148 and has a head 158 engaging a pivotable link 159. The link 159 is pivotally secured to the frame member 11 about the pivot 160 and includes a force transfer surface 161 for engagement by the roller 162. The roller 162 is connected with the member 49 for rotation therewith about the shaft 50.

When the member 49 is in the position illustrated in FIG. 5, the roller 162 engages the surface 161 to cause the right end of the link 159 to be in a down position. This in turn causes the arm 149 to also be in a down position against the force of the spring 154 as a result of the member 155 and respective engagement between its heads 156, 158 and the members 149, 148. In this position, the font is freely movable on the font post 29 (FIG. 2). As the lettering cycle continues, the roller 162 rotates out of engagement with the surface 161. This allows the arm 149 and the link 159 to move upwardly as a result of the spring 154 acting against the housing 148. Such upward movement causes the alignment tab 151 and notch 152 to move upwardly into engagement with the alignment rib on the underside of the font.

Although the description of the preferred embodiment has been quite specific, it is contemplated that various modifications could be made without deviating from the spirit of the present invention. Accordingly, it is contemplated that the scope of the present invention be dictated by the appended claims, rather than by the description of the preferred embodiment.

We claim:

1. A lettering apparatus adapted for receiving a replaceable tape supply cartridge, said apparatus comprising:

a pair of parallel, spaced apart frame members defining a cartridge receiving cavity for receiving said tape supply cartridge;

means for creating a lettering force comprising a print bar pivotally supported between, and about an axis perpendicular to, said frame members and means for resisting force causes by pivotal movement of said print bar;

an elongated drive arm pivotally connected near its lower end between said frame members about an axis generally perpendicular to said frame members and having an upper end adapted for engagement with a tape advancement means within said tape supply cartridge; and an elongated stop arm pivotally connected near its lower end between said frame members and having an upper end adapted for engagement with a tape advancement means within said tape supply cartridge for limiting the forward movement of said tape advancement means.

2. The apparatus of claim 1 wherein said drive arm and said stop arm are disposed in generally side-by-side relationship between said frame members.

3. The apparatus of claim 2 wherein said stop arm includes means comprising a laterally extending portion for limiting the forward movement of said drive arm relative to said stop arm.

4. The apparatus of claim 1 including means for adjusting the pivotal position of said stop arm.

5. The apparatus of claim 4 wherein said means for adjusting the pivotal position of said stop arm includes an eccentric cam element,

6. A lettering apparatus adapted for receiving a replaceable tape supply cartridge of the type having a pair of spaced apart, generally parallel side walls and a tape supply provided between said side walls, said apparatus comprising:

a pair of parallel, spaced apart frame members defining a cartridge receiving cavity;

means for supporting the tape supply cartridge between said frame members so that the tape supply cartridge side walls are generally parallel to said frame members;

means for creating a lettering force comprisihg a print bar pivotally supported between, and about an axis perpendicular to, said frame members and means for resisting force caused by pivotal movement of said print bar;

an elongated drive arm pivotally connected near its lower end between said frame members about an axis generally perpendicular to said frame members and having an upper end adapted for engagement with a tape advancement means within said tape supply cartridge;

first means for causing pivotal movement of said drive arm; and second means for causing limited pivotal movement of said print bar, said first means including linkage means connected with said second means.

7. The apparatus of claim 6 wherein said means for causing pivotal movement of said drive arm includes override means facilitating varied pivotal movement of said drive arm.

8. A lettering apparatus adapted for receiving a replaceable tape supply cartridge, said apparatus comprising:

a pair of parallel, spaced apart frame members defining a cartridge receiving cavity;

means for creating a lettering force comprising a print bar pivotally supported between, and about an axis perpendicular to, said frame members and means for resisting force caused by pivotal movement of said print bar; and a kerning slide mounted to an outer side of one of said frame members, said kerning slide being slidably movable relative to said one frame member between a forward position and a rearward, kerning position.

9. The apparatus of claim 8 wherein said kerning slide includes a cartridge engagement tab extending through a first opening in, and inwardly of, said one frame member.

10. The apparatus of claim 9 wherein said kerning slide includes means comprising a spring biased alignment member extending through a second opening in said one frame member for biasing said tape supply cartridge toward the other of said frame members.

11. The apparatus of claim 8 including an elongated drive arm pivotally connected near its lower end between said frame members about an axis generally perpendicular to said frame members and having an upper end adapted for engagement with a tape advancement means within said tape supply cartridge and an elongated stop arm pivotally connected near its lower end between said frame members and having an upper end adapted for engagement with a tape advancement means within said tape supply cartridge.

12. The apparatus of claim 11 including means connecting said drive arm and said stop arm with said kerning slide such that movement of said kerning slide causes corresponding pivotal movement of said drive arm and stop arm.

13. The apparatus of claim 12 including means comprising a kerning solenoid for causing rearward movement of said kerning slide.

14. A lettering apparatus adapted for receiving a replaceable tape supply cartridge, said apparatus comprising:

a pair of parallel, spaced apart frame members defining a cartridge receiving cavity for receiving said tape supply cartridge;

means for creating a lettering force comprising a print bar pivotally supported between, and about an axis perpendicular to, said frame members and means for resisting force caused by pivotal movement of said print bar;

means for causing limited pivotal movement of said print bar comprising a pivot link pivotally supported between said frame members about an axis generally perpendicular thereto and a transfer link pivotally connected at one end to said pivot link and at its other end to said print bar;

force adjustment means for adjusting the lettering force comprising an eccentric shaft pivotally supporting said pivot link between said frames and mounted in an eccentric bushing; and means for rotating said eccentric bushing including a cable assembly.

* * * * *